US010655806B2

(12) United States Patent
Patton

(10) Patent No.: US 10,655,806 B2
(45) Date of Patent: May 19, 2020

(54) SYSTEMS AND METHODS FOR GENERATING A REALISTIC FLAME EFFECT

(71) Applicant: L&L Candle Company, LLC, Eden Prairie, MN (US)

(72) Inventor: Douglas Patton, Irvine, CA (US)

(73) Assignee: L&L Candle Company, LLC, Eden Prairie, MN (US)

( * ) Notice: Subject to any disclaimer, the term of this patent is extended or adjusted under 35 U.S.C. 154(b) by 646 days.

(21) Appl. No.: 15/053,537

(22) Filed: Feb. 25, 2016

(65) Prior Publication Data

US 2016/0258586 A1 Sep. 8, 2016

Related U.S. Application Data

(60) Provisional application No. 62/120,509, filed on Feb. 25, 2015.

(51) Int. Cl.
*F21S 10/04* (2006.01)
*F21W 121/00* (2006.01)

(52) U.S. Cl.
CPC ..... *F21S 10/046* (2013.01); *F21S 10/04* (2013.01); *F21W 2121/00* (2013.01); *F21W 2121/002* (2013.01); *Y10S 362/81* (2013.01)

(58) Field of Classification Search
CPC ..... F21S 10/04; F21S 10/043; F21S 10/046; F21S 6/001; Y10S 362/81
USPC ..... 362/569, 161, 392, 447, 810
See application file for complete search history.

(56) References Cited

U.S. PATENT DOCUMENTS

| | | | |
|---|---|---|---|
| 3,639,749 | A | 2/1972 | Beckman |
| 4,328,534 | A | 5/1982 | Abe |
| 4,551,794 | A | 11/1985 | Sandell |
| 7,159,994 | B2 | 1/2007 | Schnuckle |
| 7,261,455 | B2 | 8/2007 | Schnuckle et al. |
| 7,350,720 | B2 | 4/2008 | Jaworski et al. |
| 7,481,571 | B2 | 1/2009 | Bistritzky et al. |
| 7,503,668 | B2 | 3/2009 | Porchia et al. |
| 7,824,627 | B2 | 11/2010 | Michaels et al. |
| 7,837,355 | B2 | 11/2010 | Schnuckle |
| 8,007,132 | B2 | 8/2011 | Huang |
| 8,070,319 | B2 | 12/2011 | Schnuckle et al. |
| 8,132,936 | B2 | 3/2012 | Patton et al. |
| 8,342,712 | B2 | 1/2013 | Patton et al. |
| 8,534,869 | B2 | 9/2013 | Patton et al. |
| 8,550,660 | B2 | 10/2013 | Patton et al. |
| 8,628,223 | B2 | 1/2014 | Kwok et al. |
| 8,646,946 | B2 | 2/2014 | Schnuckle et al. |

(Continued)

FOREIGN PATENT DOCUMENTS

| | | | |
|---|---|---|---|
| CN | 101865413 | A | 10/2010 |
| CN | 201724143 | U | 1/2011 |

(Continued)

*Primary Examiner* — Bryon T Gyllstrom
*Assistant Examiner* — Colin J Cattanach
(74) *Attorney, Agent, or Firm* — Law Office of Scott C. Harris

(57) ABSTRACT

Various embodiments of flame elements and candle housings are disclosed for use in an electric lighting device or candle to help produce a realistic flickering flame effect. The flame element and/or housing can be configured to eliminate noise that occurs when the flame element contacts a wall of the housing.

11 Claims, 3 Drawing Sheets

(56) References Cited

U.S. PATENT DOCUMENTS

| | | | | |
|---|---|---|---|---|
| 8,696,166 | B2 | 4/2014 | Patton et al. | |
| 8,721,118 | B2 | 5/2014 | Patton et al. | |
| 8,727,569 | B2 | 5/2014 | Schnuckle et al. | |
| 8,789,986 | B2 | 7/2014 | Li | |
| 8,894,261 | B2 | 11/2014 | Chen | |
| 8,926,137 | B2 | 1/2015 | Li | |
| 9,033,553 | B2 | 5/2015 | Li | |
| 9,052,078 | B2 | 6/2015 | Sheng | |
| 9,074,741 | B2 | 7/2015 | Ding | |
| 9,909,728 | B2 * | 3/2018 | Dong | F21S 10/046 |
| 2005/0169666 | A1 | 8/2005 | Porchia et al. | |
| 2005/0285538 | A1 | 12/2005 | Jaworski et al. | |
| 2006/0034079 | A1 | 2/2006 | Schnuckle et al. | |
| 2006/0034100 | A1 | 2/2006 | Schnuckle et al. | |
| 2006/0039835 | A1 | 2/2006 | Nottingham et al. | |
| 2006/0125420 | A1 | 6/2006 | Boone et al. | |
| 2006/0146544 | A1 | 7/2006 | Leung | |
| 2007/0127249 | A1 | 6/2007 | Medley et al. | |
| 2008/0031784 | A1 | 2/2008 | Bistritzky et al. | |
| 2008/0038156 | A1 | 2/2008 | Jaramillo | |
| 2008/0117633 | A1 | 5/2008 | Li | |
| 2008/0129226 | A1 | 6/2008 | DeWitt et al. | |
| 2008/0130266 | A1 | 6/2008 | DeWitt et al. | |
| 2008/0150453 | A1 | 6/2008 | Medley et al. | |
| 2008/0310149 | A1 * | 12/2008 | Chan | F21S 6/001 362/186 |
| 2010/0079999 | A1 | 4/2010 | Schnuckle | |
| 2011/0019422 | A1 | 1/2011 | Schnuckle et al. | |
| 2011/0027124 | A1 | 2/2011 | Albee et al. | |
| 2011/0110073 | A1 | 5/2011 | Schnuckle et al. | |
| 2011/0127914 | A1 | 6/2011 | Patton et al. | |
| 2011/0134628 | A1 * | 6/2011 | Pestl | F21V 33/004 362/96 |
| 2012/0020052 | A1 | 1/2012 | McCavit et al. | |
| 2012/0024837 | A1 | 2/2012 | Thompson | |
| 2012/0093491 | A1 | 4/2012 | Browder et al. | |
| 2012/0134157 | A1 * | 5/2012 | Li | F21S 6/001 362/277 |
| 2013/0050985 | A1 * | 2/2013 | Kwok | F21S 6/001 362/96 |
| 2013/0100686 | A1 | 4/2013 | Patton et al. | |
| 2013/0148353 | A1 | 6/2013 | Patton et al. | |
| 2013/0258648 | A1 | 10/2013 | Ding | |
| 2014/0177212 | A1 | 6/2014 | Li | |
| 2014/0211458 | A1 | 7/2014 | Lai | |
| 2014/0211499 | A1 * | 7/2014 | Fong | F21S 6/001 362/558 |
| 2014/0218903 | A1 * | 8/2014 | Sheng | F21S 10/046 362/190 |
| 2014/0218929 | A1 | 8/2014 | Schnuckle et al. | |
| 2014/0241004 | A1 | 8/2014 | Chen | |
| 2014/0362592 | A1 * | 12/2014 | Lee | F21S 10/046 362/386 |
| 2015/0036348 | A1 * | 2/2015 | Dong | F21S 10/046 362/293 |
| 2015/0049472 | A1 | 2/2015 | Lai | |
| 2015/0055331 | A1 | 2/2015 | Lai | |
| 2015/0109786 | A1 | 4/2015 | Li | |
| 2015/0233538 | A1 | 8/2015 | Sheng | |
| 2015/0285453 | A1 | 10/2015 | Schnuckle et al. | |
| 2015/0292698 | A1 | 10/2015 | Schnuckle et al. | |
| 2015/0308643 | A1 * | 10/2015 | Huang | F21S 10/046 362/157 |
| 2015/0362141 | A1 | 12/2015 | Chen | |
| 2016/0040843 | A1 | 2/2016 | Patton et al. | |
| 2016/0047517 | A1 | 2/2016 | Li | |
| 2016/0109082 | A1 | 4/2016 | Li | |
| 2016/0109083 | A1 | 4/2016 | Li | |
| 2016/0116127 | A1 | 4/2016 | Patton | |
| 2016/0138770 | A1 | 5/2016 | Patton | |

FOREIGN PATENT DOCUMENTS

| | | | |
|---|---|---|---|
| CN | 102734740 | A | 10/2012 |
| CN | 203442498 | U | 2/2014 |
| CN | 102721002 | B | 6/2014 |
| CN | 204240261 | U | 4/2015 |
| CN | 204300960 | U | 4/2015 |
| CN | 204300961 | U | 4/2015 |
| CN | 303219547 | S | 5/2015 |
| CN | 303219548 | S | 5/2015 |
| CN | 303219561 | S | 5/2015 |
| CN | 204534425 | U | 8/2015 |
| DE | 202011109285 | U1 | 3/2012 |
| DE | 202014105614 | U1 | 3/2015 |
| EP | 2587127 | A1 | 6/2011 |
| JP | 2012-89462 | A | 5/2012 |
| WO | 2006/020839 | A2 | 2/2006 |
| WO | 2012/000418 | A1 | 1/2012 |
| WO | 2013/020263 | A2 | 2/2013 |
| WO | 2014/169809 | A1 | 10/2014 |
| WO | 2015/021066 | A2 | 2/2015 |
| WO | 2015/080664 | A1 | 6/2015 |
| WO | 2015/109115 | A1 | 7/2015 |
| WO | 2016/022721 | A1 | 2/2016 |

* cited by examiner

SYSTEMS AND METHODS FOR GENERATING A REALISTIC FLAME EFFECT

This application claims priority to U.S. provisional application having Ser. No. 62/120,509, filed on Feb. 25, 2015. This and all other referenced extrinsic materials are incorporated herein by reference in their entirety. Where a definition or use of a term in a reference that is incorporated by reference is inconsistent or contrary to the definition of that term provided herein, the definition of that term provided herein is deemed to be controlling.

FIELD OF THE INVENTION

The field of the invention is electric lights and candles.

BACKGROUND

The following background discussion includes information that may be useful in understanding the present invention. It is not an admission that any of the information provided herein is prior art or relevant to the presently claimed invention, or that any publication specifically or implicitly referenced is prior art.

Various electric lights are known in the art. See, e.g., U.S. Pat. No. 8,132,936 to Patton et al., U.S. Pat. No. 8,070,319 to Schnuckle et al., U.S. Pat. No. 7,837,355 to Schnuckle et al., U.S. Pat. No. 7,261,455 to Schnuckle et al., U.S. Pat. No. 7,159,994 to Schnuckle et al., US 2011/0127914 to Patton et al., U.S. Pat. No. 7,350,720 to Jaworski et al.; US 2005/0285538 to Jaworski et al. (publ. December 2005); U.S. Pat. No. 7,481,571 to Bistritzky et al.; US 2008/0031784 to Bistritzky et al. (publ. February 2008); US 2006/0125420 to Boone et al. (publ. June 2006); US 2007/0127249 to Medley et al. (publ. June 2007); US 2008/0150453 to Medley et al. (publ. June 2008); US 2005/0169666 to Porchia, et al. (publ. August 2005); U.S. Pat. No. 7,503,668 to Porchia, et al.; U.S. Pat. No. 7,824,627 to Michaels, et al.; US 2006/0039835 to Nottingham et al. (publ. February 2006); US 2008/0038156 to Jaramillo (publ. February 2008); US 2008/0130266 to DeWitt et al. (publ. June 2008); US 2012/0024837 to Thompson (publ. February 2012); US 2011/0134628 to Pestl et al. (publ. June 2011); US 2011/0027124 to Albee et al. (publ February 2011); US 2012/0020052 to McCavit et al. (publ. January 2012); and US 2012/0093491 to Browder et al. (publ. April 2012).

These and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

Unless the context dictates the contrary, all ranges set forth herein should be interpreted as being inclusive of their endpoints, and open-ended ranges should be interpreted to include commercially practical values. Similarly, all lists of values should be considered as inclusive of intermediate values unless the context indicates the contrary.

However, there is still a need for improved candles and other light sources that more closely produce a realistic flame effect.

SUMMARY OF THE INVENTION

The inventive subject matter provides apparatus, systems and methods for various embodiments of electric candles or other lighting devices that produce a flickering flame effect. One exemplary electric candle is discussed in U.S. patent application having Ser. No. 14/819,146 filed on Aug. 5, 2015. In preferred embodiments, the candles include a flame element that is at least partially illuminated by a primary light source. Various embodiments of the flame element are shown in FIGS. 1-16.

Various objects, features, aspects and advantages of the inventive subject matter will become more apparent from the following detailed description of preferred embodiments, along with the accompanying drawing figures in which like numerals represent like components.

DESCRIPTION OF THE INVENTION

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

Figure 1:
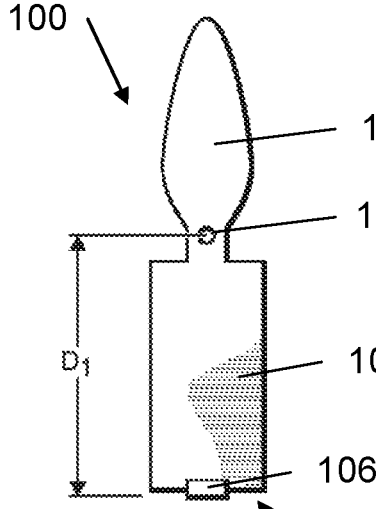
FIGS. 1-2 show front and side views of one embodiment of a flame element.
Figure 2:
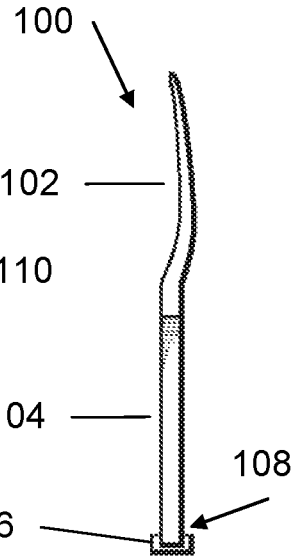

FIGS. 1 and 2 illustrate front and side views of a flame element 100 having a rectangular lower surface 104 with a magnet 106 at the bottom 108 and a hole 110 disposed between upper and lower surfaces 102 and 104 of the flame element 100, preferably in a middle portion that is narrower than a maximum width/diameter of the upper and lower surfaces 102 and 104. The hole 110 advantageously is sized to be larger than a diameter of a support wire or other piece that extends through the hole to thereby allow at least two degrees of movement of the flame element 100. A distance from the hole 110 and the bottom 108 of the flame element 100 is D1.

Figure 3:
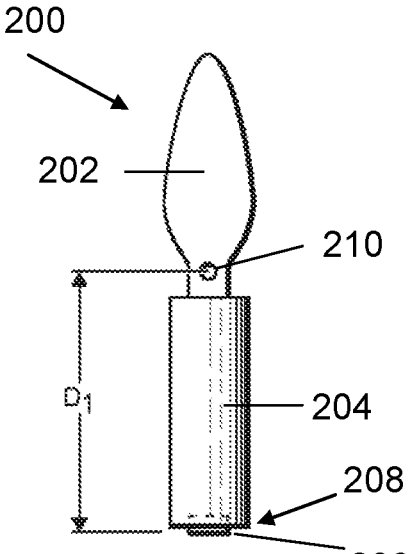
FIG. 3 shows another embodiment of a flame element having a lower surface with a cylindrical horizontal cross-section.

FIG. 3 illustrates another embodiment of a flame element 200 having a lower surface 204 with a cylindrical horizontal cross-section with the upper portion 202 having a tear-drop shape similar to that of FIG. 1. As in FIG. 1, a vertical distance from hole 210 of the flame element 200 to a bottom 208 of the flame element 200 equals distance D1. To ensure the center of gravity of the flame element 200 is the same as the center of gravity of the flame element 100 shown in FIG. 1, a mass of the lower surface 204 should equal the mass of the lower surface 104 of flame element 100. By utilizing a lower surface 204 having a cylindrical horizontal cross-section, a depth of the lower surface 204 is increased, while the overall width/diameter of the lower surface 204 is decreased and a height of lower surface 204 is maintained. With the reduction in a maximum width/diameter of the lower surface 204, the flame element 200 can advantageously pivot or move in more confined spaces without hitting a wall of a housing, for example. With respect to the remaining numerals in FIG. 3, the same considerations for like components with like numerals of FIG. 1 apply.

Figure 4:
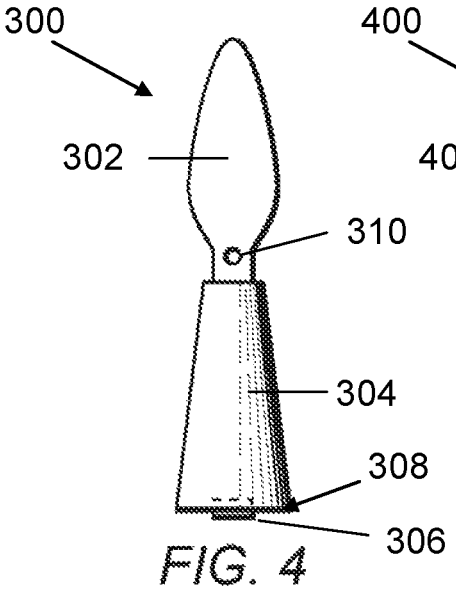
FIG. 4 shows another embodiment of a flame element having a lower surface with a conical vertical cross-section.
Figure 5:
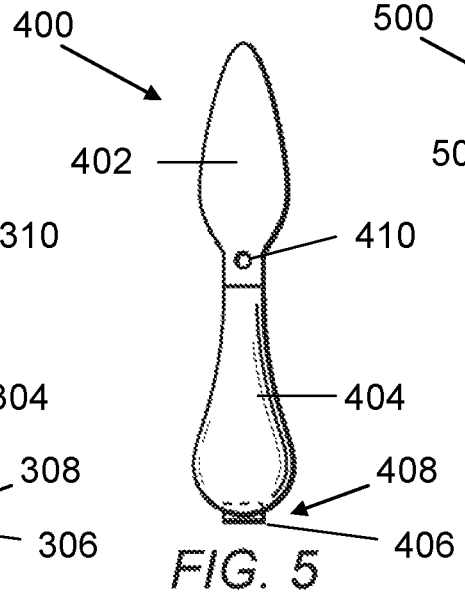
FIG. 5 shows another embodiment of a flame element having a lower surface with a tear-drop shape.

FIG. 4 illustrates another embodiment of a flame element 300 having a lower surface 304 with a conical vertical cross-section. FIG. 5 illustrates another embodiment of a flame element 400 having a lower surface 404 with a tear-drop shape. With respect to the remaining numerals in each of FIGS. 4-5, the same considerations for like components with like numerals of FIG. 1 apply.

Figure 6:
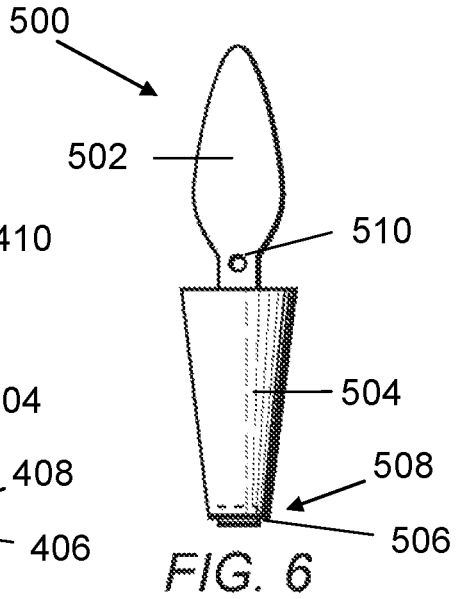
FIG. 6 shows another embodiment of a flame element having a lower surface with an upside down conical vertical cross-section.

FIG. 6 illustrates another embodiment of a flame element 500 having a lower surface 504 with an upside down conical vertical cross-section. With respect to the remaining numerals in FIG. 6, the same considerations for like components with like numerals of FIG. 1 apply.

Figure 7:
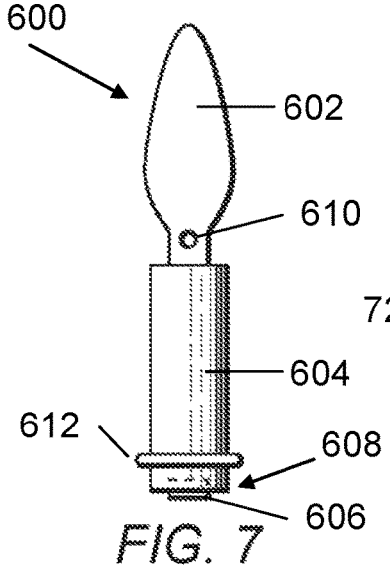
FIG. 7 shows another embodiment of a flame element having a lower surface with a cylindrical horizontal cross-section and an o-ring disposed about a portion thereof.

In FIG. 7, another embodiment of a flame element 600 is shown having a lower surface 604 with an o-ring 612 disposed about a portion thereof. The o-ring 612 advantageously helps to eliminate contact between the lower surface 604 of the flame element 600 and an outer housing to which it can be coupled. This can eliminate noise that would otherwise be generated that would take away from the flickering flame effect. Although shown having a lower surface 604 with a cylindrical horizontal cross-section, it is contemplated that the lower surface can have any commercially suitable shape without departing from the scope of invention. With respect to the remaining numerals in FIG. 7, the same considerations for like components with like numerals of FIG. 1 apply.

Figure 8:
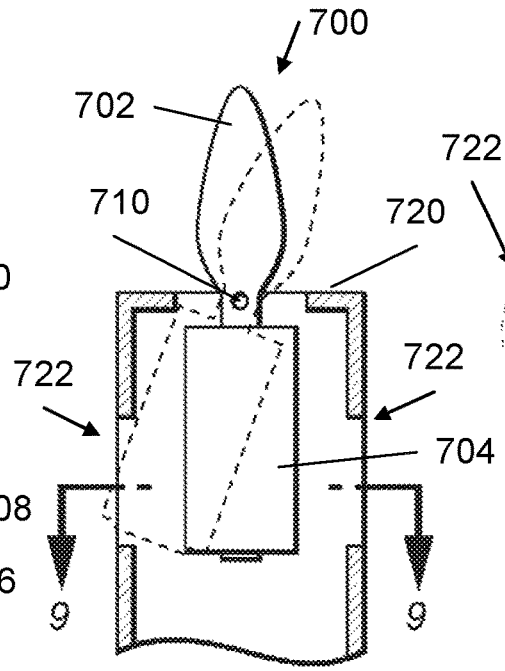
FIGS. 8-9 show a partial vertical cross-section view and a horizontal cross-section view, respectively, of one embodiment of a candle having a housing and a flame element.
Figure 9:
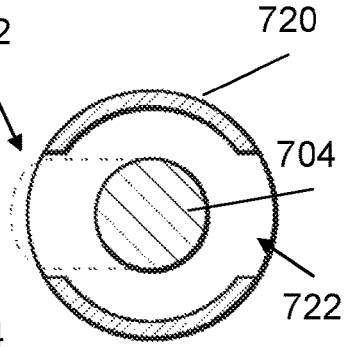

FIG. 8-9 illustrate one embodiment of a candle housing 720 to which a flame element 700 can be coupled, preferably via a wire or other support element. FIG. 8 shows a partial vertical cross-section view, and FIG. 9 shows a horizontal cross-section view. Housing 720 preferably has a hollow portion 722 disposed along a portion of a vertical length of the housing 720, such that when the flame element 700 pivots or moves within the housing 720, the flame element 700 passes into the hollow portion 722 (shown in dashed lines) rather than contact the housing 720 itself as may otherwise occur. This advantageously helps to eliminate contact between the lower surface 704 of the flame element 700 and the housing 720 to which it can be coupled, while allowing for the flame element to have a greater degree of rotation about hole 710. In addition, such embodiments can eliminate noise that would otherwise be generated that would take away from the flickering flame effect. With respect to the remaining numerals in each of FIGS. 8-9, the same considerations for like components with like numerals of FIG. 1 apply.

Figure 10:
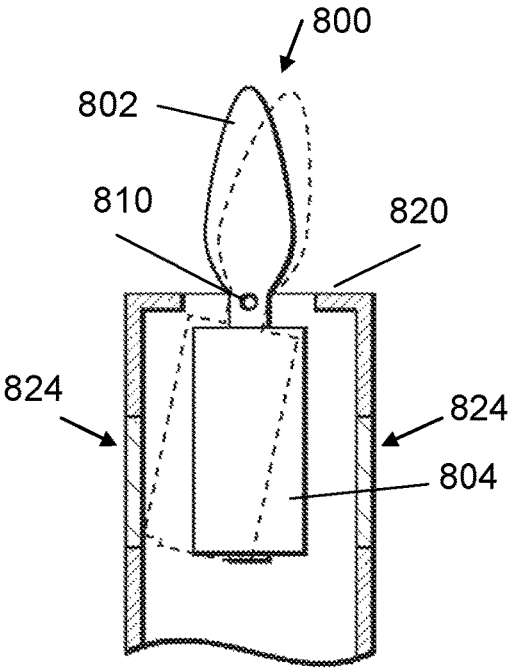
FIG. 10 shows another embodiment of a candle having a housing and flame element.

FIG. 10 illustrates another embodiment of a candle housing 820 to which a flame element 800 can be coupled. Instead of having a hollow portion, the housing 820 can have a first portion 824 that comprises an absorbent material such as foam or an elastomer, such that if the flame element 800 contacts the first portion 824, little or no sound will be created. With respect to the remaining numerals in FIG. 10, the same considerations for like components with like numerals of FIG. 1 apply.

Figure 11:
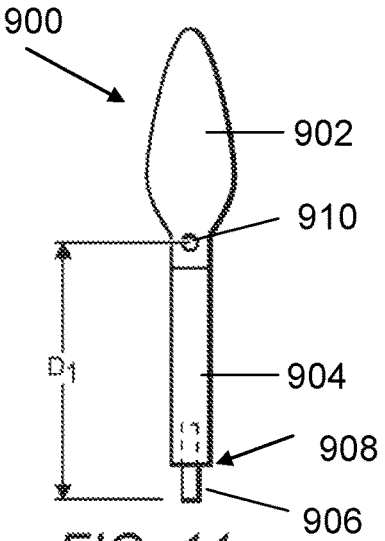
FIG. 11 shows another embodiment of a flame element.

FIG. 11 illustrates another embodiment of a flame element 900 having a lower surface 904 with a width/diameter that is equal to a minimum diameter of the flame element 900 (e.g., the diameter across a middle portion where aperture 910 is disposed). The flame element 900 can also include a magnet 906 whose length is larger than its width, and that is disposed such that the length of the magnet 906 extends along a vertical axis of the flame element 900. By reducing a diameter or width of the lower surface 904 of the flame element 900, this can help prevent the lower surface 904 from contacting a wall of the housing, for example. However, in order to reduce a length of the lower surface 904, weight must be added to the lower surface either via a different or additional material being injected molded into the lower surface 904, adding a weight to the lower surface, or increasing a weight of the magnet 906. With respect to the remaining numerals in FIG. 11, the same considerations for like components with like numerals of FIG. 1 apply.

Figure 12:
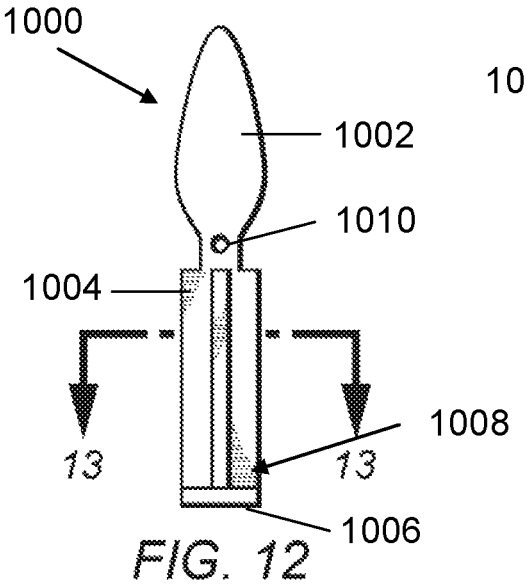
FIGS. 12-13 show front and top views, respectively, of a flame element having a x-shape horizontal cross-section.
Figure 13:
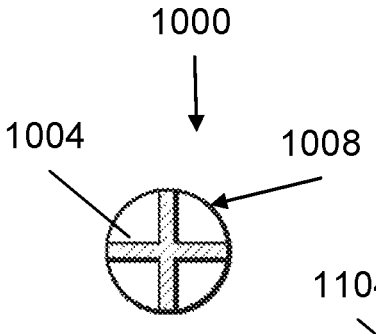

FIGS. 12 and 13 illustrate front and top views of a flame element 1000 having an x-shape horizontal cross-section with a magnet 1006 at the bottom 1008. With respect to the remaining numerals in each of FIGS. 12-13, the same considerations for like components with like numerals of FIG. 1 apply.

Figure 14:
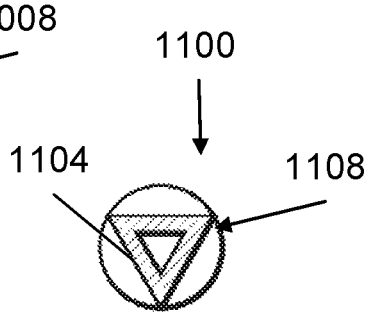
FIG. 14 shows a top view of a flame element having a triangular horizontal cross-section.

FIG. 14 illustrates a top view of a flame element 1100 having a lower surface 1104 with a triangular horizontal cross-section. Although shown hollow, it is contemplated that the lower surface 1104 could comprise a solid piece. With respect to the remaining numerals in FIG. 14, the same considerations for like components with like numerals of FIG. 1 apply.

Figure 15:
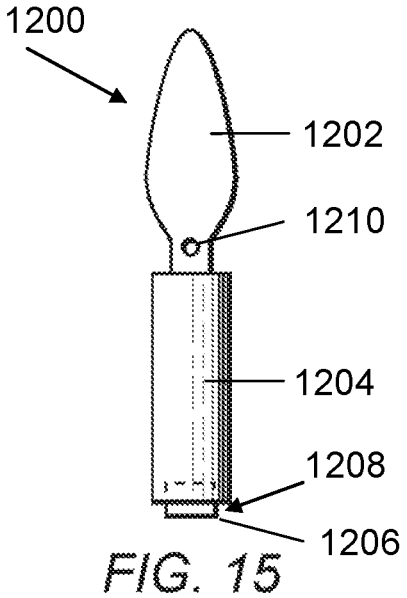
FIG. 15 shows another embodiment of a flame element having a lower surface with a cylindrical horizontal cross-section.

FIG. 15 illustrates another embodiment of a flame element 1200 having a lower surface 1204 with a cylindrical horizontal cross-section. It is contemplated that an overall size of magnet 1206 can be reduced by varying a strength of the magnet 1206 to compensate for the reduction in size. With respect to the remaining numerals in FIG. 15, the same considerations for like components with like numerals of FIG. 1 apply.

Figure 16:
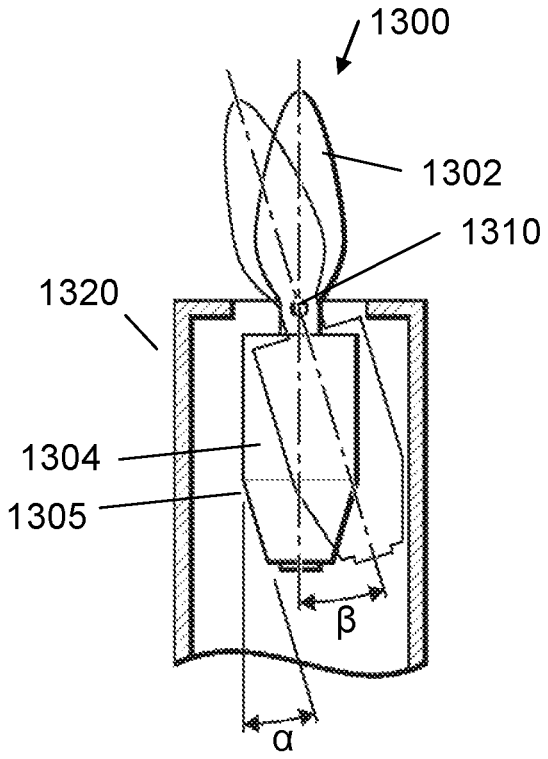
FIG. 16 shows another embodiment of a candle having a housing to which a flame element is coupled.

FIG. 16 illustrates another embodiment of a candle housing 1320 to which a flame element 1300 is coupled. The flame element 1300 can have a tapered lower surface 1304, such that when the flame element 1300 is at a maximum angle $\beta$ of movement with respect to its at rest vertical position (shown in solid), the tapered wall 1305 is parallel or approximately parallel (e.g., with one degree) to a side wall of the housing 1320. In preferred embodiments, an angle $\alpha$ of the tapered wall 1305 is equal to the flame element's maximum angle of movement. With respect to the remaining numerals in FIG. 16, the same considerations for like components with like numerals of FIG. 1 apply.

Instead of a hollow portion, the housing can have a first portion that comprises an absorbent material such as foam or an elastomer, such that if the flame element contacts the first portion, little or no sound will be created.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

It should be apparent to those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. An electric lighting device, comprising:

a housing having a top and a bottom, and having an outer wall, and having an aperture in the top of the housing;

a flame element that is coupled to the housing, and the flame element being movable with respect to the housing; and wherein the flame element comprises an upper portion and a lower portion, the upper portion being outside the housing, the lower portion being inside the housing, and a middle portion, between the lower portion and the upper portion, extending through the aperture in the top of the housing, and wherein a lower surface of the lower portion has a tapered outer surface adjoining a bottom surface of the lower portion, where the tapered outer surface forming a tapered wall, the tapered wall forming a first angle at its lower end relative to an outer wall of other sections of the lower portion other than the tapered wall, said first angle such that when the flame element is moved at a maximum angle of movement with respect to its rest vertical position, the tapered wall is parallel to or within one degree of parallel to a side wall of the housing and such that the bottom surface of the lower surface has a diameter that is less than a diameter of the lower portion at said other sections of the lower portion other than the tapered wall, and a light source disposed within the housing and configured to emit light onto the upper portion of the flame element which is outside the housing.

2. The electric lighting device of claim 1, wherein the aperture is disposed on the housing such that at least a portion of the lower surface of the flame element is periodically disposed in the aperture as the flame element moves with respect to the housing.

3. The electric lighting device of claim 1, wherein the housing further comprises a foam or elastomeric material disposed within the aperture.

4. The electric lighting device of claim 3, wherein the aperture is disposed on the housing such that at least a portion of the lower surface of the flame element periodically contacts the foam or elastomeric material as the flame element moves with respect to the housing.

5. The electric lighting device of claim 1, wherein the flame element comprises an upper and lower portion, and wherein the lower portion has a cylindrical horizontal cross-section.

6. The electric lighting device of claim 1, further comprising an o-ring disposed about the lower portion of the flame element.

7. The electric lighting device of claim 1, further comprising a magnet disposed at a bottom of the flame element.

8. The electric lighting device of claim 7, wherein a width of the magnet is less than a minimum width or diameter of the flame element.

9. The electric lighting device of claim 7, wherein a diameter of the magnet is less than a width of the flame element across the aperture.

10. The electric lighting device of claim 7, wherein the magnet has a length that is greater than a width of the magnet, and wherein the magnet is disposed such that a length of the magnet extends along a vertical axis of the flame element.

11. An electric lighting device, comprising:

a housing having a top and a bottom, and having an outer wall perpendicular to the top, and the housing and the top having an aperture which extends between a hollow inside of the housing and an outside of the top of the housing, the hollow inside being cylindrical;

a flame element that is coupled to the housing, and the flame element being movable with respect to the housing wherein the flame element comprises an upper portion and a lower portion, the upper portion being outside the top of the housing, the lower portion being inside the hollow inside of the housing, and a middle portion, between the lower portion and the upper portion, the middle portion extending through the aperture in the top of the housing, and wherein a lower surface of the lower portion has a tapered outer surface adjoining a bottom surface of the lower portion, where the tapered outer surface forming a tapered wall, the tapered wall forming a first angle at its lower end relative to an outer wall of other sections of the lower portion other than the tapered wall, said first angle being non parallel to the outer wall when the lower portion is in a vertical position, and the first angle being such that when the flame element is moved at a maximum angle of movement with respect to the vertical position, the tapered wall is parallel to or within one degree of parallel to a side wall of the housing and such that the bottom surface of the lower surface has a diameter that is less than a diameter of the lower portion at said other sections of the lower portion other than the tapered wall;

and a light source disposed within the housing, and configured to emit light onto the upper portion of the flame element.

* * * * *